US005784033A

United States Patent [19]

Boldissar, Jr.

[11] Patent Number: 5,784,033

[45] Date of Patent: Jul. 21, 1998

[54] PLURAL FREQUENCY ANTENNA FEED

[75] Inventor: Frank Boldissar, Jr., Redondo Beach, Calif.

[73] Assignee: Hughes Electronics Corporation, El Segundo, Calif.

[21] Appl. No.: 660,314

[22] Filed: Jun. 7, 1996

[51] Int. Cl.[6] ..... H01Q 13/00

[52] U.S. Cl. ..... 343/786; 343/778; 333/113; 333/135

[58] Field of Search ..... 343/776, 786, 343/777, 772, 771, 778; 333/113, 126, 135, 21 A; H01Q 13/00

[56] References Cited

U.S. PATENT DOCUMENTS

| | | | |
|---|---|---|---|
| 2,922,122 | 1/1960 | Harkless | 333/113 |
| 4,704,611 | 11/1987 | Edwards et al. | 343/786 |
| 5,617,108 | 4/1997 | Silinsky et al. | 343/786 |

FOREIGN PATENT DOCUMENTS

| | | | |
|---|---|---|---|
| 0124303 | 9/1980 | Japan | 333/113 |
| 0058702 | 4/1985 | Japan | 333/135 |

*Primary Examiner*—Donald T. Hajec
*Assistant Examiner*—Tho Phan
*Attorney, Agent, or Firm*—Terje Gudmestad; Elizabeth E. Leitereg; Michael W. Sales

[57] ABSTRACT

Apparatus and method for providing an antenna feed (10) operative at different microwave frequency bands employ a circular waveguide (14) interconnecting an orthomode transducer (20) to a feed horn (16) thereby providing a feed (10) suitable for illuminating the reflector (54) of an antenna (12). The orthomode transducer provides for a coupling of waves in the first frequency band with both vertical and horizontally polarized waves. Included within the feed is a coupler assembly (26) of waves of the second frequency band operative via a sidewall of the circular waveguide. The coupler assembly includes plural identical coupling sections (28) each having a rectangular waveguide section contiguous and parallel to the circular waveguide with a row of apertures for coupling power into and out of the circular waveguide. Pairs of the coupling sections are disposed in orthogonal planes so as to introduce two linearly polarized waves which are perpendicular to each other. A slab (48) of dielectric material is placed in each of the coupling sections to match the phase velocity of waves in the coupling sections to waves in the circular waveguide at the second frequency band while mismatching the phase velocities at the first frequency band. The dispersion of the waveguides provides for interaction with electromagnetic waves in the second frequency band while inhibiting such interaction at the first frequency band.

21 Claims, 2 Drawing Sheets

PLURAL FREQUENCY ANTENNA FEED

BACKGROUND OF THE INVENTION

This invention relates to the feeding of microwave signals in a plurality of frequency bands to the reflector of an antenna, such as an antenna of a communications satellite encircling the earth, and more particularly to a single feed structure capable of operating in at least two separate frequency bands.

In the communication of signals by a satellite, microwave signals in different widely-spaced frequency bands are employed. The signals in any one frequency band are to be received by an antenna carried by the satellite, amplified by circuitry carried by the satellite, and the rebroadcast via an antenna carried by the satellite. In the case of microwave signals transmitted at widely spaced frequency bands, one method of transmitting signals in the different bands is to employ separate antennas with individual feed structures configured for operation at the respective frequency bands. This has been necessary because conventional waveguide components used in the feeds of reflector antennas are limited in bandwidth, thereby requiring separate antennas for transmit and receive frequency bands. It is preferable to employ a single feed operative at plural frequency bands to simplify the antenna system.

A problem arises in that attempts to construct plural frequency band feeds have resulted in feeds which are unduly limited in their bandwidth, are relatively complex in their structure, and are difficult to design for a designated frequency band. As a result, in many communication systems, the antenna systems must employ additional antenna feeds and reflectors to attain the desired capability for satellite communications.

SUMMARY OF THE INVENTION

The aforementioned problem is overcome and other advantages are provided by the construction of an antenna feed, both in terms of its apparatus and the methodology of the invention, wherein a horn or radiator of the feed illuminates the reflector of an antenna. In the description of the feed, it is convenient to describe the feed as illuminating the reflector with electromagnetic power, it being understood that the feed operates in reciprocal fashion so as to receive electromagnetic signals directed to the feed by the reflector.

In accordance with the invention, the feed connects with a circular waveguide which enables the coupling of electromagnetic signals at different frequency bands to the horn. For example, one signal may be referred to as the high frequency signal and the other signal may be referred to as the low frequency signal. The high and low frequency signals both propagate in the dominant $TE_{11}$ mode in the circular waveguide. An orthomode transducer is located at a first end of the circular waveguide. The horn is located at a second end of the circular waveguide opposite the transducer. In the preferred embodiment of the invention, the orthomode transducer is employed for coupling the high frequency signal via the circular waveguide to the horn. Also included in the structure of the feed is a coupler assembly having plural coupling sections disposed alongside the circular waveguide for coupling the low frequency signal via the circular waveguide to the horn. The coupling sections are arranged in orthogonal planes to provide for two linearly polarized waves which are perpendicular to each other. Similarly, the orthomode transducer has two ports for providing two linearly polarized waves which are perpendicular to each other. The planes of polarization of the low frequency signal may be inclined or parallel to the corresponding planes of polarization of the high frequency signal depending on the orientation of the coupling sections relative to the ports of the orthomode transducer.

In the preferred embodiment of the invention, the planes of polarization of the low frequency signal are parallel to the corresponding polarization planes of the high frequency signal. Each of the coupling sections comprises a rectangular waveguide having a series of coupling holes extending into the circular waveguide, the rectangular waveguides of the coupler assembly being parallel to the circular waveguide, and the coupling holes being arranged in a line extending in the longitudinal direction of the circular waveguide.

A feature of the invention is the operation of the feed in a manner wherein the coupling of the high frequency signal and the coupling of the low frequency signal can be accomplished independently of each other and without interference from each other. This is accomplished by introducing a slab of dielectric material within the waveguides of each of the coupling sections along a sidewall of each waveguide opposite the coupling holes thereby creating dispersion between the coupling sections and the circular waveguide. Appropriate choice of the coupling waveguide dimensions, slab dimension, and slab dielectric constant, allows the phase velocity of the low frequency signal in the coupling section to be equal to the phase velocity of the low frequency signal in the circular waveguide. The dispersion causes the phase velocities to be unequal at the high frequency. This promotes coupling of the low frequency signal while inhibiting interaction with the high frequency signal. Circular polarization can be obtained by introduction of a ninety degree phase shift between the orthogonal components in the low frequency signal and/or the high frequency signal.

BRIEF DESCRIPTION OF THE DRAWING

The aforementioned aspects and other features of the invention are explained in the following description, taken in connection with the accompanying drawing wherein.

DETAILED DESCRIPTION

Figure 1:
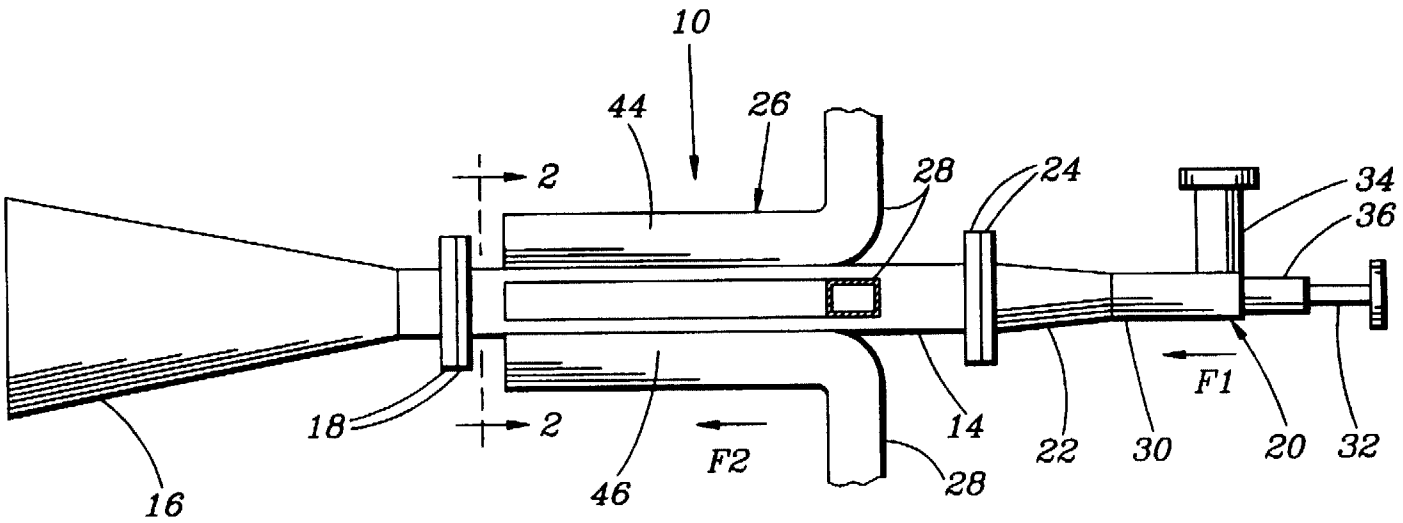
FIG. 1 is a side elevation view of a feed incorporating the invention.
Figure 3:
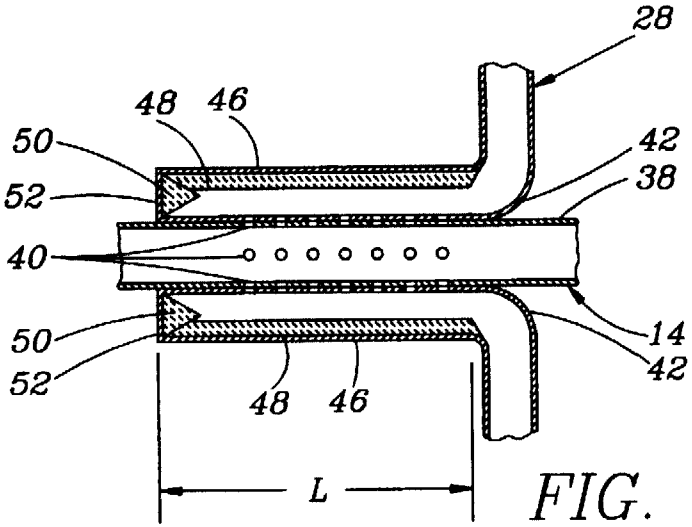
FIG. 3 is a sectional view of the feed taken along the line 3—3 in FIG. 2.

FIGS. 1–4 show construction of a feed 10 of an antenna 12 (FIG. 4) such as an antenna of a communications satellite encircling the earth. The feed 10 includes a central circular waveguide 14 with a radiating element in the form of a horn 16 connected via flanges 18 to a front end of the circular waveguide 14. An orthomode transducer 20 is coupled via waveguide transition 22 to a back end of the circular waveguide 14. The waveguide transition 22, by way of example, may be formed integrally with the transducer 20, and is secured via flanges 24 to the circular waveguide 14. The transducer 20 serves to couple signals at a frequency F1 into the circular waveguide for transmission of F1 signals by the antenna 12, and for extraction of F1 signals from the circular waveguide 14 during reception of F1 signals by the antenna 12. The feed 10 further comprises a coupler assembly 26 having a plurality of coupling sections 28 distributed circumferentially about the circular waveguide 14 for coupling signals at a frequency F2 into the circular waveguide 14 during transmission of F2 signals by the antenna 12. The feed 10 operates in reciprocal fashion so that F2 signals received by the antenna 12 are extracted from the circular waveguide 14 by the coupler assembly 26.

The orthomode transducer 20 has a well known construction including a waveguide section 30 of rectangular cross section, a first port 32 connecting to a back end of the waveguide section 30 and a second port 34 connecting to a side of the waveguide section 30. A stepped impedance-matching section 36 may be employed for connection of the first port 32 to the waveguide section 30. Both of the ports 32 and 34 are waveguide sections having rectangular cross section, and each supports a $TE_{10}$ mode of electromagnetic wave. The first port 32 couples a vertically polarized wave to the waveguide section 30, and the second port 34 couples a horizontally polarized wave to the waveguide section 30. The transition 22 begins with a rectangular cross section at its junction with the transducer 20, and flares out into a circular cross section at its junction with the circular waveguide 14. The effect of the transition 22 is to convert the vertical and horizontally polarized waves of the rectangular waveguide section 30 to the corresponding vertical and horizontally polarized waveguide modes in the circular waveguide 14.

In the coupler assembly 26, each of the coupling sections 28 functions independently of the other coupling sections to couple an electromagnetic wave through the wall 38 (FIG. 3) of the circular waveguide 14 by a series of coupling holes 40 extending through a wall 42 of the coupling section 28 and the wall 38 of the circular waveguide 14. The coupling holes 40 in each of the coupling sections 28 are arranged in a line extending in the longitudinal direction of the circular waveguide 14. Each of the coupling sections 28 comprises a rectangular waveguide having a broad wall 44 which is twice the width of the wall 42, the latter being a narrow wall. In each coupling section 28, a second narrow wall 46 is located opposite the narrow wall 42, and supports a slab 48 of dielectric material for loading the coupling section 28 so as to introduce dispersion between the signals travelling in the coupling section 28 and the signals in the circular waveguide 14. In this way, the slab 48 serves as a means for adjusting the phase velocity of the F2 signal in each coupling section 28 to match the phase velocity of the F2 signal propagating within the circular waveguide 14. And, because the coupling section 28 is dielectrically loaded, the phase velocity of the F1 signal in the coupling section 28 will not be matched to the phase velocity of the F1 signal in the circular waveguide 14, thereby inhibiting coupling at F1. A load 50 is located within each coupling section 28 at a end wall 52 of the coupling section 28 for absorbing any microwave power which is not coupled through the coupling holes 40. By way of example in the construction of the dielectric slab 48, the slab 48 may be fabricated of a ceramic material such as alumina or a plastic material such as Teflon. In the preferred embodiment of the invention, the thickness of the slab 48 extends from the wall 46 approximately one-third of the distance to the row of coupling holes 40 in the wall 42.

In operation, the frequency F1 of the signals provided by the transducer 20 differs from the frequency F2 of the signals provided by the coupler assembly 26. In the preferred embodiment of the invention the frequency F1 is higher than the frequency F2. The frequency F1 falls within the band of 22–28 GHz (gigahertz), and the frequency F2 falls within the band 13–15 GHz. Each coupling section 28 supports a $TE_{10}$ mode of electromagnetic wave from which radiant energy is coupled through the coupling holes 40 to excite a $TE_{11}$ mode in the circular waveguide 14 at frequency F2. The orthomode transducer 20 excites a $TE_{11}$ mode in the circular waveguide 14 at frequency F1. The $TE_{11}$ modes of the circular waveguide 14 have different phase velocities and guide wavelengths, the difference in phase velocity and guide wavelength being due to the difference in frequency between F1 and F2. The dimensions of the coupling section 28, dielectric slab 48, and the dielectric constant are chosen to match the phase velocity and guide wavelength of the $TE_{10}$ mode in the coupling section 28 to the $TE_{11}$ mode in the circular waveguide 14 at F2. Because of the dispersion introduced by the dielectric, the phase velocities and guide wavelengths are mismatched at F2. Thus, the $TE_{11}$ mode associated with the transducer 20 does not couple through the coupling holes 40 of a coupling section 28, and is not affected by the coupling section 28. Each coupling section 28 operates as a directional coupler which, during transmission, operates to induce a wave in the circular waveguide 14 which travels in the forward direction towards the horn 16 and, upon reception, operates to couple a wave from the horn 16 out of the circular waveguide 14. In each coupling section 28, the coupling holes 40 are spaced at 0.25 guide wavelengths of the mode propagating in the waveguide of the coupling section 28 to maximize the directivity of the coupling, the coupling being via an end-launched wave from a coupling section 28.

It is noted that the hole spacing of the coupling holes 40 is not resonant at the F1 frequency, so as to prevent interaction between a coupling hole 40 and an F1 signal. Each hole 40 couples only a small fraction of the total energy of the wave in the coupling section 28, but there are a sufficient number of the holes 40 so as to couple, in a preferred embodiment of the invention, at least 98% of the microwave power. Any uncoupled energy is dissipated in resistance of the load 50 at the end of each coupling section 28.

In the preferred embodiment of the invention, each of the coupling sections 28 has a length, L, (FIG. 3) of approximately one foot, and has approximately 27–30 coupling holes 40 at a spacing of 200 mils and with an approximate diameter of 152 mils. With each of the coupling sections 28, the electromagnetic field induced in the circular waveguide 14 has an electric field parallel to the wall 42 of the coupling section 28. Thus, the coupling section 28 at the top of the circular waveguide 14 (as viewed in FIG. 2) provides for a horizontally polarized electric field in the circular waveguide 14. Similarly, the coupling section 28 at the bottom of the circular waveguide 14 induces a horizontally polarized electric field to the wave in the circular waveguide 14. In corresponding manner, the coupling section 28 on the right side of the circular waveguide 14 provides for a vertically polarized wave in the circular waveguide 14, and the coupling section 28 on the left side of the circular waveguide 14 also induces a vertically polarized wave within the circular waveguide 14. Thus, by arranging the four coupling sections 28 circumferentially around the circular waveguide 14 with angular spacing of 90 degrees, the coupler assembly 26 is capable of coupling both horizontally and vertically polarized waves in the circular waveguide 14.

Figure 2:
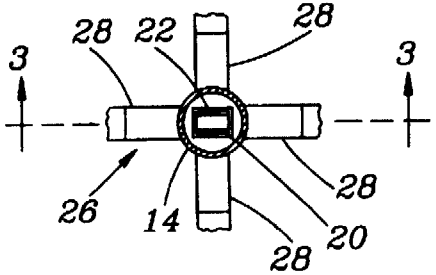
FIG. 2 is a sectional view of the feed taken along the line 2—2 in FIG. 1.
Figure 4:
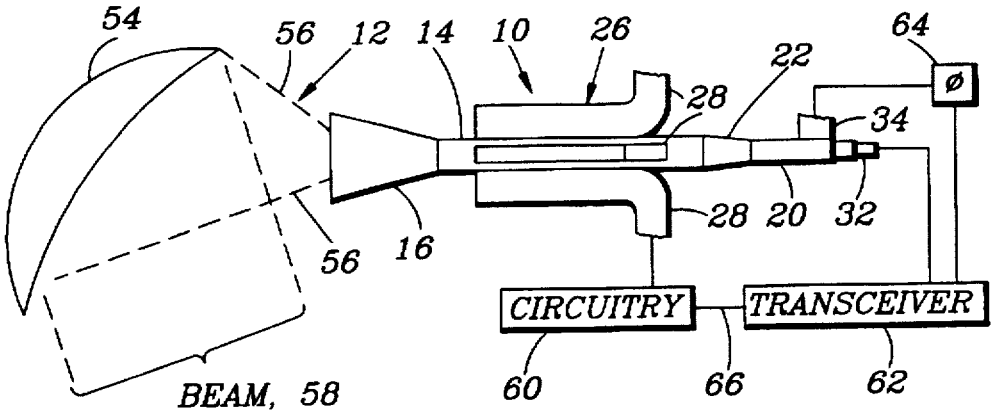
FIG. 4 is a diagrammatic view of an antenna comprising the feed of FIG. 1 and a reflector illuminated by the feed during transmission.

Since there is no interaction between the coupler assembly 26 and the F1 signals of the orthomode transducer 20, the orientation of the array of the four coupling sections 28 can be oriented at any desired orientation, and need not necessarily be oriented, as shown in FIG. 2, with coupling sections 28 arranged in horizontal and vertical planes. Thus, if desired, the array of coupling sections 28 could be oriented at 45 degrees relative to the horizontal and the vertical planes. Furthermore, since each coupling section 28 is capable of operating independently of the other coupling section 28, an operative embodiment of the feed 10 can be constructed with only one of the coupling sections 28; however, such structure would provide for only one polarization of the F2 signal. The use of two of the coupling sections 28 oriented perpendicularly to each other enables the generation of F2 signals at two mutually perpendicular polarizations. The use of all four of the coupling sections 28, as is provided in the preferred embodiment of the invention, maximizes coupling of the F2 signal to the circular waveguide 14 in both of the mutually perpendicular polarizations and reduces the length of the coupling sections.

The invention is particularly useful in satellite communication systems by reducing the number of reflector antennas required to provide a desired communications mission. The antenna 12 (FIG. 4) includes a reflector 54 which is illuminated by rays 56 emanating from the horn 16 for collimating the rays 56 to produce a beam 58 oriented in a desired direction, such as to illuminate a portion of the United States with a broadcast transmission from the satellite. During reception, parallel rays of radiant energy incident upon the reflector 54 are made to converge toward the horn 16 to be received by the feed 10. Since the feed 10 is capable of operating in both a low and a high frequency band, the single antenna 12 can be employed for both transmit and receive frequencies rather than requiring separate antenna structures for transmit and receive frequencies. The coupling sections 28 are connected to circuitry 60, as will be described in further detail in FIG. 5, for the generation and reception of signals in the F2 frequency band. Similarly, circuitry such as a transceiver 62 and a phase shifter 64 may be coupled to the ports of the orthomode transducer 20 for generation and reception of signals in the F2 frequency band.

By way of example in the operation of a satellite communications system, a signal may be received in the higher F1 frequency band via the transceiver 62, converted to the lower frequency band in the transceiver 62, and applied via line 66 to the circuitry 60 to serve as a source of signals to be transmitted back to the earth. In this way, the circuitry of the satellite serves as a repeater for receiving signals from the earth in one frequency band, and transmitting the signals back to the earth in a different frequency band. The invention may be employed for other purposes, in addition, such as the storage of signals in storage circuitry (not shown) connected to either the transceiver 62 or the circuitry 60, and may include a signal generator for generating a signal based on previously stored information. Furthermore, by selectively phasing signals at the two orthogonal polarizations, such as the two F1 signals at the ports 32 and 34 of the transducer 20, the two linear polarizations can be combined to produce a circularly polarized wave within the circular waveguide 14 and the horn 16. The circular polarization is accomplished by employing the phase shifter 64 to induce a phase shift of 90 degrees between two signals at the same frequency applied to the ports 32 and 34 of the transducer 20. In similar fashion, the coupler assembly 26 can be employed to operate with a circularly polarized wave by employing a phase shifter to produce a 90 degree phase shift between the orthogonal linearly polarized waves, as is disclosed in FIG. 5.

Figure 5:
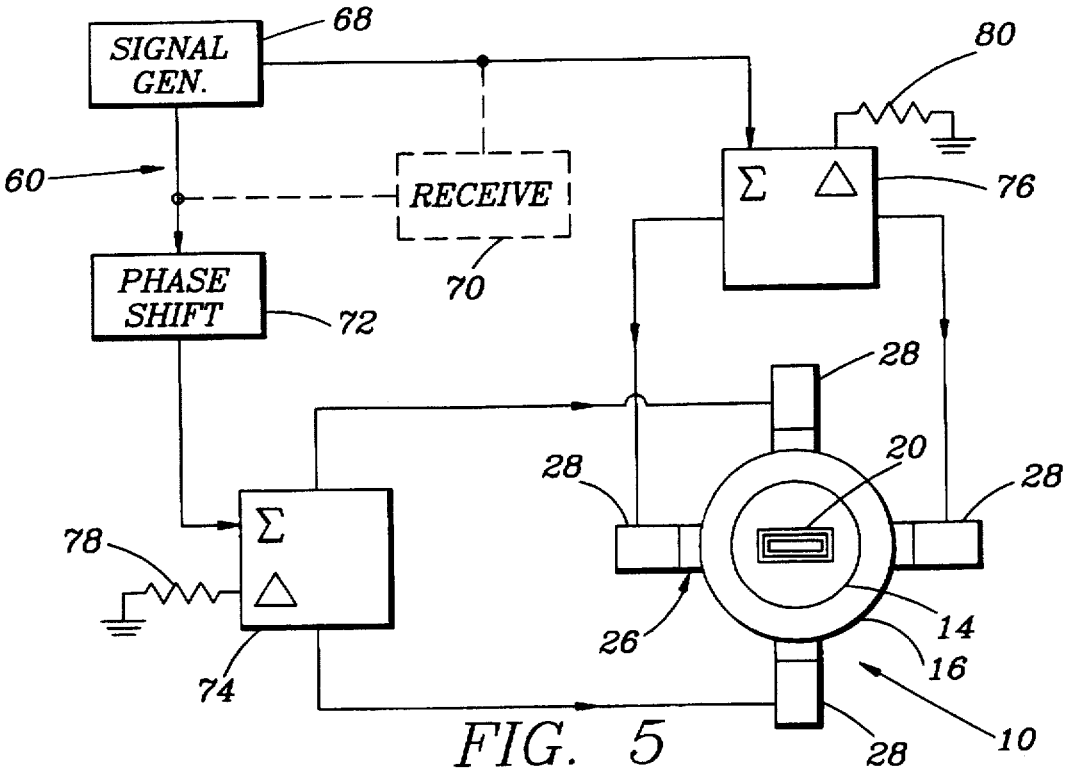
FIG. 5 shows connection of a signal generator, or receiver shown in phantom, to sections of a coupler assembly of the feed of FIG. 1.

FIG. 5 shows details of the circuitry 60 connecting with the coupler assembly 26. The circuitry 60 includes a signal generator 68, a receiver 70 which is shown in phantom, a phase shifter 72 and two magic-tee power dividers 74 and 76. For transmission of a signal in the F2 frequency band, the signal generator 68 outputs the signal directly via a power divider 76 to the horizontally disposed coupling sections 28, and outputs the signal via the phase shifter 72 and the power divider 74 to the vertically disposed coupling sections 28. In each of the power dividers 74 and 76, the inputted signal of the generator 68 is applied via a sum terminal, and the difference terminals of the dividers 74 and 76 are terminated by resistors 78 and 80 connected to ground.

The power divider 74 divides the power evenly and with equal phase shift between the two vertically disposed coupling sections 28. Similarly, the power divider 76 divides the power evenly and with equal phase shift between the two horizontally disposed coupling sections 28. By introducing a phase shift of 90 degrees at the phase shifter 72, the vertical and horizontally polarized components of the F2 signal are placed in phase quadrature so as to provide circular polarization. In the event that the signals outputted by the generator 68 to the dividers 74 and 76 differ in amplitude, then the circular polarization is converted to elliptical polarization. Also, in the event that the phase shift of the shifter 72 is set at a value of zero, the orientation of the resulting linear polarization can be selected by adjustment of the relative amplitudes between the signals inputted to the two dividers 74 and 76. For reception of signals via the feed 10, the receiver 70 is employed instead of the generator 68. The dividers 74 and 76 are operative in reciprocal fashion to provide, during reception, for a combination or summation of the signals of the respective coupling sections 28 for application to the receiver 70. Again, by use of the phase shifter 72, the receiver 70 can be rendered responsive to circular polarization or to linear polarization. A phase shift of 90 degrees established by the shifter 72 provides for the reception of circular polarization at the receiver 70.

Figure 6:
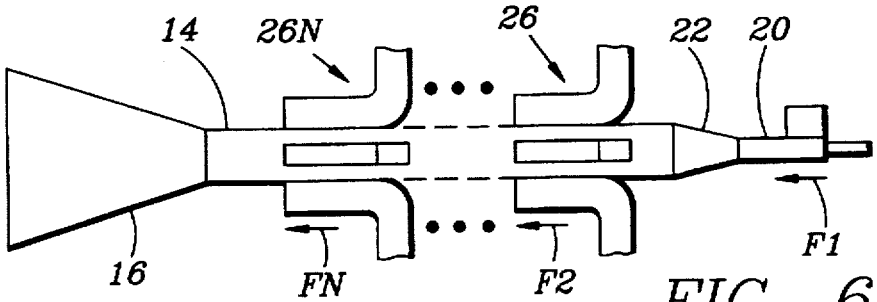
FIG. 6 is a stylized view of a further embodiment of the feed structure including a plurality of coupler assemblies disposed in tandem along a central circular waveguide of the feed structure.

FIG. 6 shows a further embodiment of the invention in which additional frequency bands are employed, one of the additional frequency bands being indicated as $F_N$. The additional frequency bands are accommodated by introduction of additional coupler assemblies 26 connecting with the circular waveguide 14. One such additional coupler 26N is shown in FIG. 6. The coupler 26N operates in the same fashion as does the coupler 26, but the spacing between coupling holes differs in accordance with the wavelength of signals in the $F_N$ frequency band. In view of the different phase velocity of the various couplers, there is essentially no interaction between signals of the frequency bands F1, F2, and $F_N$. Thereby, signals at various bands and with independently controllable polarization can be accommodated with the feed of the invention.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A method of communicating two different electromagnetic wave signals having frequencies falling within two different frequency bands via a single antenna, the method comprising the steps of:

providing a first waveguide for concurrently carrying first and second electromagnetic signals without interference therebetween, the first signals having a frequency in a first band and the second signals having a frequency in a second band different than the first band;

locating a second waveguide adjacent and parallel to said first waveguide;

aligning a series of coupling holes defined in said second waveguide with a series of holes defines in said first waveguide; and dielectrically loading said second waveguide with dielectric material extending along said second waveguide opposite said holes to inhibit the first signals from passing between the first and second waveguides and for facilitating communication of the second signals between said first and second waveguides.

2. A method according to claim 1 wherein said first waveguide has a circular cross section and said second waveguide has a rectangular cross section.

3. A method according to claim 1 further comprising the step of:

placing a third waveguide adjacent to said first waveguide, the third waveguide being spaced apart from said second waveguide by 90 degrees in the circumferential direction around said first waveguide, said third and said second waveguides being operative to couple crossed linearly polarized waves into and out of said first waveguide.

4. An antenna feed operative for propagating signals comprising:

a transducer for generating first signals having a frequency in a first frequency band;

a circular waveguide coupled to the transducer;

a horn coupled to the circular waveguide opposite the transducer;

first and second waveguides at least partially disposed adjacent said circular waveguide, the first and the second waveguides being spaced apart from each other by 90 degrees in a circumferential direction around said circular waveguide, each of the first and second waveguides having a series of coupling holes extending into said circular waveguide for coupling second signals between the first and second waveguides and the circular waveguide, the second signals having a frequency in a second frequency band different from the first frequency band; and first and second dielectric slabs respectively disposed in the first and second waveguides, the first and second dielectric slabs respectively inhibiting the first signals from entering the first and second waveguides from the circular waveguide while respectively facilitating coupling of the second signals between the first and second waveguides and the circular waveguide whereby the first and second signals can traverse the circular waveguide concurrently without interference therebetween.

5. A feed according to claim 4 wherein said transducer comprises a rectangular waveguide having a first port and a second port, and wherein the feed further comprises a transition connecting the rectangular waveguide of said transducer to said circular waveguide.

6. A feed according to claim 5 wherein a signal applied to the first port of said transducer induces a vertically polarized electromagnetic wave in said circular waveguide, and a signal applied to the second port of said transducer induces a horizontally polarized electromagnetic wave in said circular waveguide.

7. A feed according to claim 5 wherein a signal applied to said first waveguide induces a first linearly polarized electromagnetic wave in said circular waveguide, and a signal applied to said second waveguide induces a second linearly polarized electromagnetic wave perpendicular to said first linearly polarized wave in said circular waveguide; and wherein introduction of a ninety degree phase shift between signals of equal magnitude applied at the first and the second ports of said transducer result in a circularly polarized electromagnetic wave having said first frequency in said circular waveguide; and introduction of a ninety degree phase shift between signals of equal magnitude applied to said first and said second waveguides results in a circularly polarized wave at said second frequency in said circular waveguide.

8. A feed according to claim 5 wherein said second port of said transducer and the second waveguide are coplanar.

9. A feed according to claim 4 wherein said first frequency band is higher than said second frequency band.

10. A feed according to claim 4 further comprising third waveguide located on said circular waveguide diametrically opposite said first waveguide and a fourth waveguide located on said circular waveguide diametrically opposite said second waveguide, each of said third and fourth waveguides having a series of coupling holes arranged in the longitudinal direction of said circular waveguide and extending into the circular waveguide for coupling the second signals between said third and fourth waveguides and said circular waveguide.

11. A feed according to claim 4 wherein said horn extends outward from said circular waveguide with a conical flare.

12. An antenna feed as defined in claim 4 wherein the second signals in the first waveguide have a different magnitude than the second signals in the third waveguide.

13. An antenna feed as defined in claim 4 wherein the second signals in the first and third waveguides have a first magnitude and the second signals in the second and fourth waveguides have a second magnitude.

14. An antenna feed as defined in claim 13 wherein the first and second magnitudes are different.

15. An antenna feed as defined in claim 13 wherein the first and second magnitudes are substantially the same.

16. An antenna feed as defined in claim 4 wherein the second signals in the second waveguide have a different magnitude than the second signals in the fourth waveguide.

17. An antenna feed as defined in claim 4 wherein the first and second signals traverse the circular waveguide concurrently.

18. An antenna feed as defined in claim 4 wherein the first frequency band is approximately 13–15 GHz and the second frequency band is approximately 22–28 GHz.

19. An antenna feed as defined in claim 4 wherein the first frequency band is approximately 22–28 GHz and the second frequency band is approximately 13–15 GHz.

20. An antenna feed as defined in claim 4 wherein the first and second signals propagate in a dominant mode.

21. An antenna feed operative for propagating signals comprising:

a transducer for generating first signals at a first frequency falling within a first frequency band;

a circular waveguide coupled to the transducer;

a horn coupled to the circular waveguide opposite the transducer;

a first waveguide at least partially disposed adjacent said circular waveguide, the first waveguide having a series of coupling holes extending into said circular waveguide for coupling second signals between the first waveguide and the circular waveguide, the second signals having a frequency falling within a second frequency band; and means for respectively inhibiting the first signals from entering the first waveguide from the circular waveguide while respectively facilitating coupling of the second signals between the first waveguide and the circular waveguide whereby the first and second signals can traverse the circular waveguide concurrently without interference therebetween and wherein the first and second frequency bands are separated by at least 7 GHZ.

* * * * *